US006714114B2

(12) United States Patent
Matsumura et al.

(10) Patent No.: US 6,714,114 B2
(45) Date of Patent: Mar. 30, 2004

(54) MAGNETIC STICKING SHEET AND METHOD OF PRODUCING SAME

(75) Inventors: Shinichi Matsumura, Miyagi (JP); Miki Sudo, Miyagi (JP); Kazuto Kawamata, Miyagi (JP); Eiji Ohta, Miyagi (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/452,346

(22) Filed: Jun. 2, 2003

(65) Prior Publication Data

US 2003/0206091 A1 Nov. 6, 2003

Related U.S. Application Data

(62) Division of application No. 10/194,764, filed on Jul. 12, 2002.

(30) Foreign Application Priority Data

Jul. 27, 2001 (JP) ..... 2001-228542

(51) Int. Cl.[7] ..... H01F 27/24
(52) U.S. Cl. ..... 336/233; 148/307; 428/323
(58) Field of Search ..... 336/83, 200, 206–208, 336/233; 428/323–329, 694 B–694 BC; 148/307–308

(56) References Cited

U.S. PATENT DOCUMENTS 4,741,977 A * 5/1988 Koga et al. ..... 428/694 BC
4,992,329 A * 2/1991 Ishii et al. ..... 428/328
5,714,017 A * 2/1998 Tomida et al. ..... 148/308
5,993,568 A * 11/1999 Takada et al. ..... 148/307
6,312,795 B1 * 11/2001 Yamamoto ..... 428/323

FOREIGN PATENT DOCUMENTS

JP 08-277624 * 10/1996
JP 09-63484 * 3/1997

* cited by examiner

*Primary Examiner*—Tuyen T. Nguyen
(74) *Attorney, Agent, or Firm*—Lewis T. Steadman; Holland & Knight LLP

(57) ABSTRACT

A magnetic sticking sheet comprising a non-magnetic base and a magnetic layer formed on the non-magnetic base by coating a magnetic coating material containing ferromagnetic particles and a binder, the magnetic layer having a thickness of 0.03 to 0.10 mm, oriented longitudinally to give a squareness ratio of 80 to 90%, and multipolar-magnetized longitudinally; the sheet having a total thickness of 0.08 to 0.25 mm and flexibility for rolling; the magnetic layer having a surface magnetic flux density of 35 to 100G; and the sheet having a magnetic sticking force, required for removing a magnetic sticking sheet fixed magnetically on a magnetic surface via the magnetic layer while keeping the magnetic surface and the sheet parallel, of 0.4 to 0.9 gf/cm$^2$.

4 Claims, 6 Drawing Sheets

A
11
14
14
12a
12b
AXIS OF EASY MAGNETIZATION
S N S N S N

MAGNETIC STICKING SHEET AND METHOD OF PRODUCING SAME

The present application is a divisional of U.S. application Ser. No. 10/194,764. filed Jul. 12, 2002, which claims priority to Japanese Patent Application No. JP2001-228542. filed Jul. 27, 2001. The present application claims priority to each of these previously filed applications. The subject matter of application Ser. No. 10/194,764 is incorporated herein by reference.

BACKGROUND OF THE INVENTION

1. Field of the Invention

The present invention relates to a magnetic sticking sheet able to be supplied in a rolled state and a method of producing the sheet, more particularly relates to a magnetic sticking sheet suitable for printing by the sheet by feeding it from the rolled state and a method of producing the sheet.

2. Description of the Related Art

Magnetic sticking sheets using magnetic attraction of a magnet are widely used as various types of display tools. Particularly, they are widely used in offices.

In recent years, along with the rapid spread of personal computers, the performance of printers and other peripherals has been remarkably improved. The printing quality of personal printers is becoming comparable to the printing quality of business printers. In the field of business printers, demand for printers able to print on large size paper such as A0, A1, B0, B1 size paper has increased. At the same time, there is a growing desire to use such large size printed matter.

The most important use of large sized printed matter is posters. Posters are fixed to bulletin boards using various types of adhesives, adhesive tape, thumb tacks, capped magnets, and other fasteners. A magnetic sticking sheet poster is convenient in that the poster itself is a fastener having a magnetic sticking property. If the bulletin board has a ferromagnetic surface, no other fastener is needed. That is, the sheet can be fastened to the bulletin board on its own. Also, the sheet can be freely peeled off from the bulletin board.

Generally, magnetic sticking sheets are sheet type bond magnets. Along with their expanded applications, sheet type bond magnets have been made thinner. In recent years, magnetic sticking sheets produced by extrusion or injection molding having a thickness of the magnetic layer of about 0.1 mm and a total thickness of about 0.25 mm have been commercialized. These magnetic sticking sheets have axes of easy magnetization oriented perpendicularly to the surface of the magnetic layer and are magnetized perpendicularly. For example, U.S. Pat. No. 6,312,795 discloses a magnetic sheet of this type.

FIG. 1 shows schematically the magnetic layer 2 of the magnetic sticking sheet having an axis of easy magnetization perpendicular to the surface of the magnetic layer. As shown in FIG. 1, the magnetic layer 21 and attachment 9 are attached magnetically. The magnetic layer 21 is multipolar-magnetized at a certain pitch of magnetic poles. The N-poles and S-poles arranged alternately at an interface between the magnetic layer 21 and the attachment 9 generate a magnetic field shown by the magnetic lines of force 22.

A magnet generates a magnetic field outside it due to the N-poles and S-poles. On the other hand, the magnet also generates a magnetic field inside it due to the same magnetic poles. This is called a "demagnetizing field". The demagnetizing field faces the magnetic circuit formed by the outer magnetic field, so acts to demagnetize the magnet itself.

In the way that a magnetic field becomes stronger the shorter the distance between the N-S magnetic poles, the demagnetizing field becomes stronger and the magnet becomes more easily demagnetized the shorter the distance between the N-S magnetic poles.

As shown in FIG. 1, the conventional magnetic sticking sheet oriented and magnetized perpendicularly to the surface of the magnetic layer has a distance between magnetic poles equal to the thickness of the magnetic layer. Therefore, in order to increase the distance between magnetic poles and reduce the demagnetizing field, the thickness of the magnetic layer must be increased. On the other hand, when thinning the magnetic layer for the purpose of improving easiness of cutting and/or handling of the magnetic sticking sheet, the distance between magnetic poles consequently becomes short and demagnetizing field increases. Therefore, it becomes easy to be demagnetized.

Also, in the production of magnetic sticking sheets by extrusion, a paste containing a mixture of a particle type magnetic material and binder is processed at a high temperature and high pressure, so the equipment becomes large in size. In the case of injection molding, the thinner the magnetic sticking sheet, the more difficult it is to form and the greater the load on the equipment.

Further, since the conventional magnetic sticking sheet oriented and magnetized perpendicularly to the surface of the magnetic layer is so thick in total thickness as to be hard to roll and its magnetic sticking force is as high as 1.0 gf/cm$^2$ or more, printing by printers for personal or business use is difficult. If printing on such magnetic sticking sheets by a printer for personal or business use in the same manner as printing on normal paper, the sheets would stick to each other making precise alignment and smooth feed impossible.

Particularly, when rolling magnetic sticking sheets having too strong a magnetic sticking force, the ends of the roll will become uneven or the roll will become slack. If magnetic sticking sheets are fed into a printer from a roll with uneven ends or having slackness, the magnetic sticking sheets will not be precisely positioned.

On the other hand, Japanese Patent No. 1460017 discloses a method of producing a magnetic sticking sheet including a step of coating a magnetic coating material containing magnetic particles to form a magnetic layer having a thickness of 0.1 to 0.3 mm, a step of orienting an axis of easy magnetization longitudinally (in-plane or parallel to a surface of the magnetic layer), and a step of multipolar-magnetization. It is described that the magnetic sticking force after magnetization is insufficient when the thickness of the magnetic layer is less than 0.1 mm. In practice, a sufficient magnetic sticking force is observed only at a 0.2 mm thickness of the magnetic layer in the embodiments of the patent. There is no description about the desirable squareness ratio in this patent. In this patent, a capacitor and yoke are used for magnetization.

In Japanese Unexamined Patent Publication (Kokai) No. 2001-76920 too, a flexible magnetic sheet having a magnetic film formed by coating a magnetic coating material containing hard magnetic particles is described. The flexible magnetic sheet has an axis of easy magnetization oriented longitudinally and is multipolar-magnetized longitudinally. In this publication, as an example of the method of multipolar-magnetization of the magnetic layer in a longitudinal direction, a method using a capacitor and yoke is mentioned.

This flexible magnet sheet can be made uniformly thin and be printed. As an example in the publication, a flexible magnetic sheet having a thickness of the magnetic layer of 0.07 mm and a sticking force of about 240 $N/m^2$ (≈2.4 $gf/cm^2$) is described.

The publication gives as examples including printing an example of printing a sheet cut to the A4 type size by a printer and an example of printing a sheet cut to a tape form by a thermal transfer type label writer. The publication does not describe a roll type sheet of a large size such as A0 applicable to high quality printing. Also, it does not investigate the characteristics of a magnetic sticking sheet suitable for feeding in a printer from a rolled state. When rolling a sheet having a magnetic sticking force equal to that of the above examples of the publication, their magnetic attraction force is too strong, the magnetic repulsive force has an effect, and shaping the roll becomes difficult. Therefore, it is impossible to print it normally by a printer.

When printing on paper having a size of for example A3 to A5, B4, B5, or so, a stack of paper cut in advance to the predetermined size is often used. In the case of an A0 type or other large size paper printer, however, if the paper is pre-cut and stacked, the area occupied by the printer will become remarkably large. Therefore, at present, roll paper is used for all of commercially available printers for large size paper.

As described above, the demand for large size paper printers has grown. A greater variety of paper is also demanded for such large size paper printers. To print on magnetic sticking sheets by a large size paper printer, the magnetic sticking sheets must be rolled. Therefore, it is necessary to make the magnetic sticking sheets as thin as normal paper and suppress the magnetic sticking force compared with a conventional magnetic sticking sheet. On the other hand, in consideration of use of a printed magnetic sticking sheet as a poster, the magnetic sticking sheet is required to have a magnetic sticking force able to support its own weight.

In addition to the above problems, the conventional method of producing a magnetic sticking sheet has another problem in that it consumes a large amount of electric power for magnetization and therefore is high in production cost. Magnetization of a magnetic sticking sheet requires a strong magnetic field. Up to now, as described in for example Japanese Patent No. 1460017 and Japanese Unexamined Patent Publication No. 2001-76920, magnetization has been performed by using a capacitor and yoke. The need for equipment for generating a strong magnetic field and the enormous amount of power consumed by the equipment remarkably increases the production cost of the magnetic sticking sheet.

Also, according to the methods of producing a flexible magnetic sheet described in Japanese Patent No. 1460017 and Japanese Unexamined Patent Publication No. 2001-76920, though a sheet having an axis of easy magnetization in a longitudinal direction to the magnetic layer is formed, a coated film with a magnetic coating material is dried after orienting the axis of easy magnetization. In other words, it is not dried in a magnetic field. In this case, it is difficult to raise the squareness ratio. This is disadvantageous for controlling the magnetic sticking force to within a desired range.

Summarizing the problems to be solved by the present invention, a conventional perpendicularly oriented and magnetized magnetic sticking sheet cannot be made thinner. Also, a conventional longitudinally oriented and magnetized magnetic sticking sheet is not suitable for rolling or feeding in printers from a rolled state. Further, the conventional method of producing a magnetic sticking sheet consumes too much electric power for magnetization.

SUMMARY OF THE INVENTION

An object of the present invention is to provide a magnetic sticking sheet having an axis of easy magnetization longitudinal to a magnetic layer reduced in demagnetizing field, resistant to demagnetization even when being made thin, resistant to poor rolling when rolled, and suitable for printing by a printer.

Another object of the present invention is to provide a method of producing a magnetic sticking sheet able to produce at low cost a rollable magnetic sticking sheet having a suitable magnetic sticking force.

According to a first aspect of the present invention, there is provided a magnetic sticking sheet comprising a non-magnetic base and a magnetic layer formed on the non-magnetic base by coating a magnetic coating material comprised of ferromagnetic particles dispersed in binder, a magnetic layer having a thickness of 0.03 to 0.10 mm, the magnetic layer having an axis of easy magnetization of the ferromagnetic particle oriented to give a squareness ratio of 80 to 90% in a parallel direction to a surface of the magnetic layer, the magnetic layer being multipolar-magnetized so that magnetization inverts alternately in a parallel direction to a surface of the magnetic layer, and the sheet having a total thickness of 0.08 to 0.25 mm including the thickness of the non-magnetic base, the sheet has enough flexibility to be rolled, a surface magnetic flux density of the magnetic layer of 35 to 100 Gauss (G), and a magnetic sticking force, required for removing a magnetic sticking sheet fixed magnetically on a magnetic surface via the magnetic layer while keeping the magnetic surface and the magnetic sticking sheet parallel, of 0.4 to 0.9 $gf/cm^2$.

Accordingly, when rolling a long magnetic sticking sheet, the ends of the roll become uniform and the roll does not become slack.

According to a second aspect of the present invention, there is provided a method of producing a magnetic sticking sheet comprising the steps of coating on a non-magnetic base a magnetic coating material comprised of ferromagnetic particles dispersed in binder to form a coated film; orienting an axis of easy magnetization of the ferromagnetic particles in a parallel direction to the coated film by applying a magnetic field; drying the coated film while orienting the axis of easy magnetization by drying in the magnetic field to obtain a squareness ratio of 80 to 90% in the parallel direction to the coated film; further drying the coated film to form a magnetic layer; and multipolar-magnetizing the magnetic layer as the magnetization inverts alternately in the parallel direction to the magnetic layer, the step of multipolar-magnetization including the step of placing a combined permanent magnet comprised of a plurality of magnets stacked facing each other with different magnetic poles so as to face at least a side of the magnetic sticking sheet where the magnetic layer is formed.

BRIEF DESCRIPTION OF THE DRAWINGS

These and other objects and features of the present invention will become clearer from the following description of a preferred embodiment given with reference to the accompanying drawings, in which.

DESCRIPTION OF THE PREFERRED EMBODIMENTS

Below, a preferred embodiment of a magnetic sticking sheet and a method of producing the same of the present invention will be described with reference to the accompanying drawings.

Figure 1:
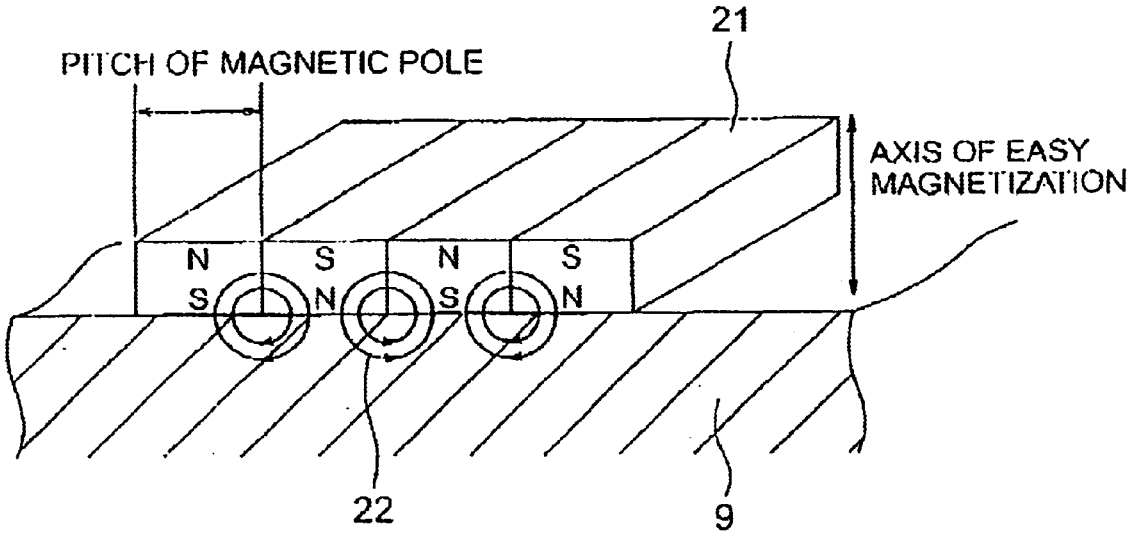
FIG. 1 is a perspective view of a conventional magnetic sticking sheet having an axis of easy magnetization in a perpendicular direction to a surface of the magnetic layer, showing multipolar-magnetization and magnetic sticking.

FIG. 1 is a schematic cross-sectional view of a rollable magnetic sticking sheet of the present embodiment. The magnetic sticking sheet 1 of the present embodiment has a magnetic layer 2 with an axis of easy magnetization oriented longitudinally (in-plane or parallel to a surface of the magnetic layer.)

The magnetic layer 2 is multipolar-magnetized so that the magnetization inverts alternately in a longitudinal direction. The magnetic sticking sheet 1 has a non-magnetic base 3 provided with a printable layer 4. Note that the printable layer 4 does not have to be provided depending on the material or surface condition of the non-magnetic base 3.

The magnetic sticking force of the magnetic sticking sheet 1 is set to about 0.4 to 0.9 gf/cm$^2$. Also, it is preferable that a surface magnetic flux density of the magnetic sticking sheet 1 be set to about 35 to 100G. Due to this, when rolling the magnetic sticking sheet, uneven end surfaces of the roll and slackness of the roll can be prevented.

A magnetic coating film wherein the axis of easy magnetization is oriented longitudinally to the magnetic layer 2 is multipolar-magnetized in the direction of the axis of easy magnetization as (N-S)(S-N) (N-S). Due to this, it is possible to generate a leakage magnetic flux maximized at a perpendicular direction to the magnetic layer 2 from a surface between same magnetic poles such as S-S or N-N. Therefore, the magnetic sticking sheet of the present embodiment can exhibit an effective magnetic sticking force with the surface of a ferromagnetic wall such as steel plate.

Figure 3:
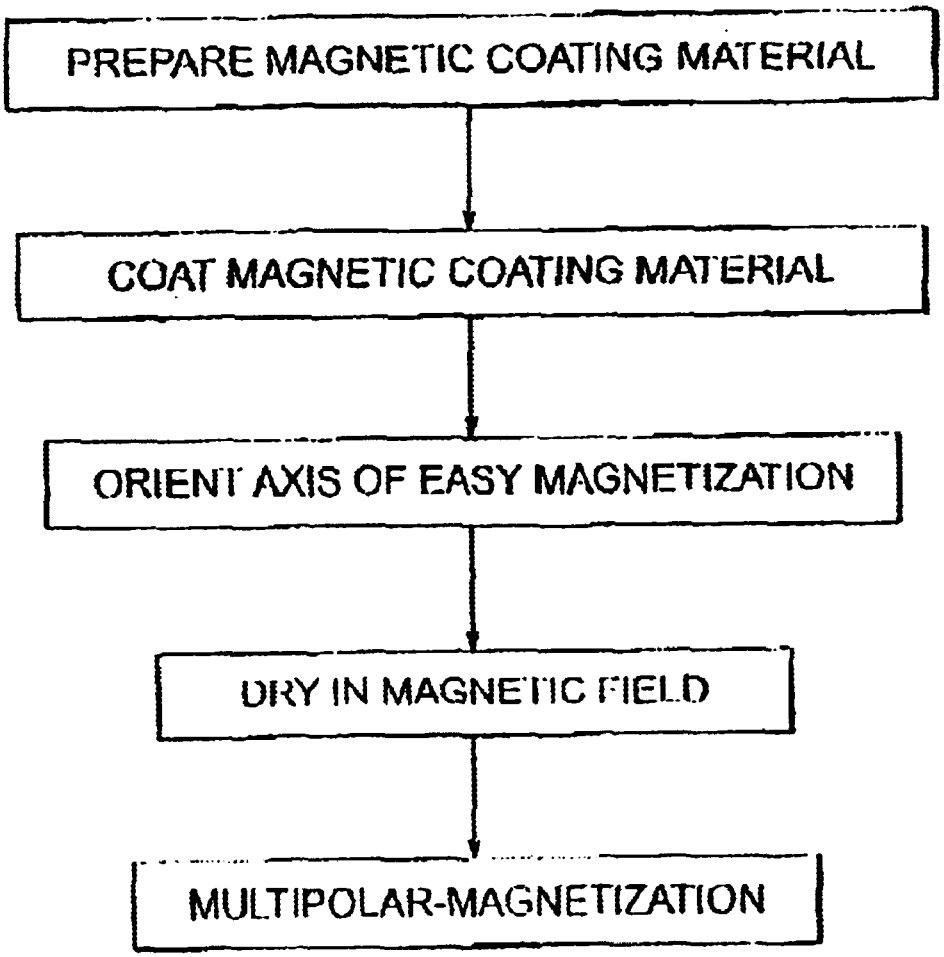
FIG. 3 is a flow chart of a method of producing a magnetic sticking sheet of the present invention.

FIG. 3 shows a flow chart of the method of producing a magnetic sticking sheet of the present embodiment. As shown in FIG. 3, first a magnetic coating material is prepared. Next, the magnetic coating material is coated on the non-magnetic base. Then, an axis of easy magnetization is oriented longitudinally. Next, the coated film is dried in a magnetic field to form a magnetic layer. After this, the magnetic layer is multipolar-magnetized.

Figure 4:
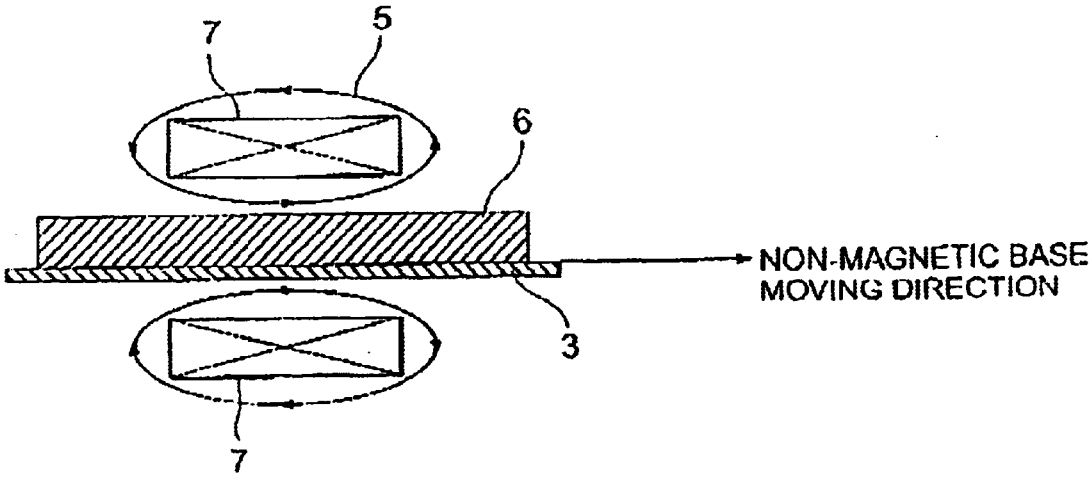
FIG. 4 is a schematic view of orienting an axis of easy magnetization of magnetic particles longitudinally to the magnetic layer using solenoid coils in a method of producing a magnetic sticking sheet of the present invention.
Figure 5:
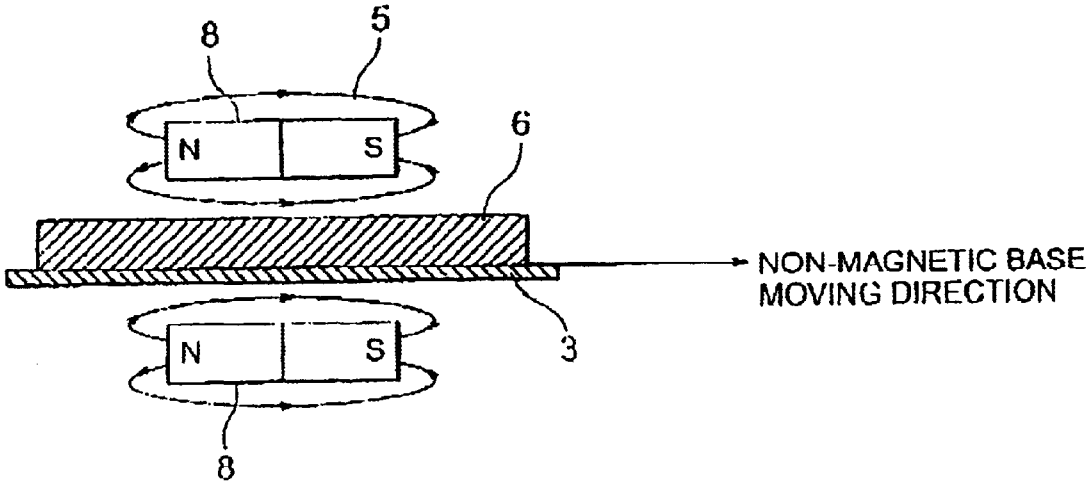
FIG. 5 is a schematic view of orienting an axis of easy magnetization of magnetic particles longitudinally to the magnetic layer using permanent magnets in a method of producing a magnetic sticking sheet of the present invention.

Further, when orienting an axis of easy magnetization longitudinal to the magnetic layer 2, an outer magnetic field can be generated in the direction increasing the magnetic force as shown with magnetic lines of force 5 of FIG. 4 or FIG. 5 so that a high squareness ratio can be obtained easily. When the non-magnetic base 3 is passed through a magnetic field of a magnetic flux parallel to a direction of movement of the non-magnetic base 3 just after coating a magnetic coating material, the axis of easy magnetization of the ferromagnetic particles can be oriented continuously by the magnetic field in a longitudinal direction to the coated film.

FIG. 4 shows schematically a method of orientation of the axis of easy magnetization of magnetic particles in a longitudinal direction to the magnetic coated film 6 by supplying an outer (extrinsic) magnetic field from solenoid coils 7 on the magnetic coated film 6 on the non-magnetic base 3. As shown in FIG. 4, when the magnetic coated film 6 passes between a pair of solenoid coils 7, the magnetic particles become oriented.

FIG. 5 shows schematically a method of orientation of magnetic particles in a longitudinal direction to the magnetic coated film 6 by supplying an extrinsic magnetic field from permanent magnets 8 on the magnetic coated film 6 on the non-magnetic base 3. As shown in FIG. 5, when the magnetic coated film 6 passes between a pair of permanent magnets 8, the magnetic particles become oriented. The pair of permanent magnets 8 are placed so that the same poles face each other via the magnetic coated film 6. Due to repulsion between the permanent magnets 8, a magnetic flux is generated in a direction of movement of the non-magnetic base 3.

Figure 6:
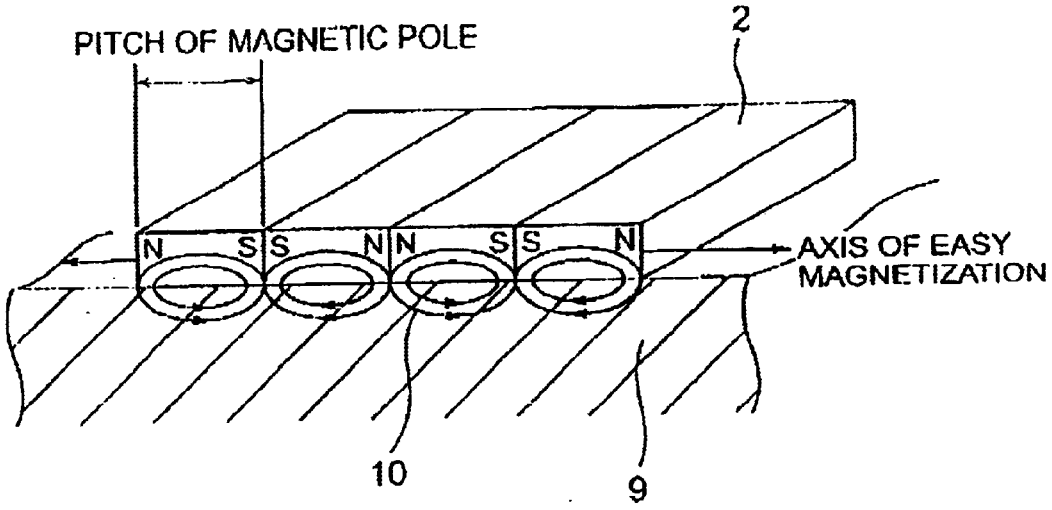
FIG. 6 is a perspective view of a magnetic sticking sheet having an axis of easy magnetization in a longitudinal direction of the present invention, showing multipolar-magnetization and magnetic sticking.

FIG. 6 shows schematically the magnetic layer of the magnetic sticking sheet of the present embodiment having an axis of easy magnetization longitudinal to the magnetic layer. As shown in FIG. 6, the magnetic layer 2 and an attachment 9 are attached magnetically. The magnetic layer 2 has an axis of easy magnetization longitudinal to a surface of the magnetic layer. The magnetic layer 2 is multipolar-magnetized at a certain pitch of magnetic poles. Due to the N-poles and S-poles being arranged alternately in the magnetic layer 2, a magnetic field shown with magnetic lines of force 10 is generated.

In a conventional magnetic sticking sheet having an axis of easy magnetization perpendicular to the surface of the magnetic layer, the distance between unit magnets is equivalent to the thickness of the sheet, so the maximum value of magnetic force does not change when changing the width of the unit magnets (pitch of magnetic poles of FIG. 1). As opposed to this, in the magnetic sticking sheet of the present embodiment shown in FIG. 6, the larger the width of the unit magnets (pitch of magnetic poles), the further the distance between magnetic poles and the greater the maximum value of magnetic force.

Also, the distance between magnetic poles does not depend on the thickness of the magnetic layer 2, so the distance between magnetic poles is sufficiently secured even when making the magnetic layer thinner. Therefore, the demagnetizing field is not increased and demagnetization is difficult. Further, when sticking magnetically to the attachment acting as a yoke, the magnetic circuit is almost completely closed and the leakage magnetic flux can be minimized.

Figure 2:
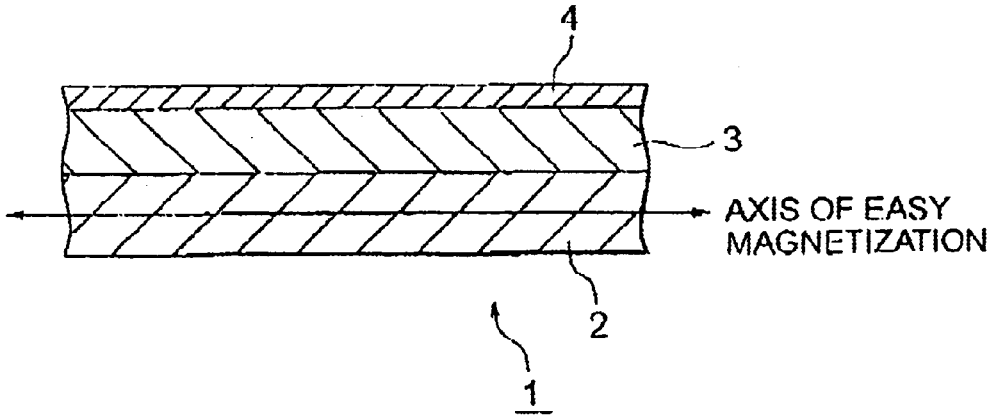
PRIOR ART FIG. 2
FIG. 2 is a cross-sectional view of a magnetic sticking sheet of the present invention.

In the magnetic sticking sheet 1 of the present embodiment shown in FIG. 2, the magnetic layer 2 is composed of a magnetic coated film mainly comprising magnetic particles and a binder. The axis of easy magnetization is oriented to give a squareness ratio in a longitudinal direction to the magnetic layer 2 of 80% or more. When the axis of easy magnetization is oriented to give a less than 80% squareness ratio in the longitudinal direction to the magnetic layer 2, a predetermined magnetic sticking force cannot be always obtained after magnetization.

It is preferable to provide the layer 4 printable by various types of printing methods at the surface of the non-magnetic base 3 not provided with the magnetic layer 2. The printable layer 4 may have been already printed by a copy machine, printer, etc. By printing on the magnetic sticking sheet of the present invention and sticking it magnetically to, for example, a steel bulletin board, it can be used as various types of posters.

Figure 7:
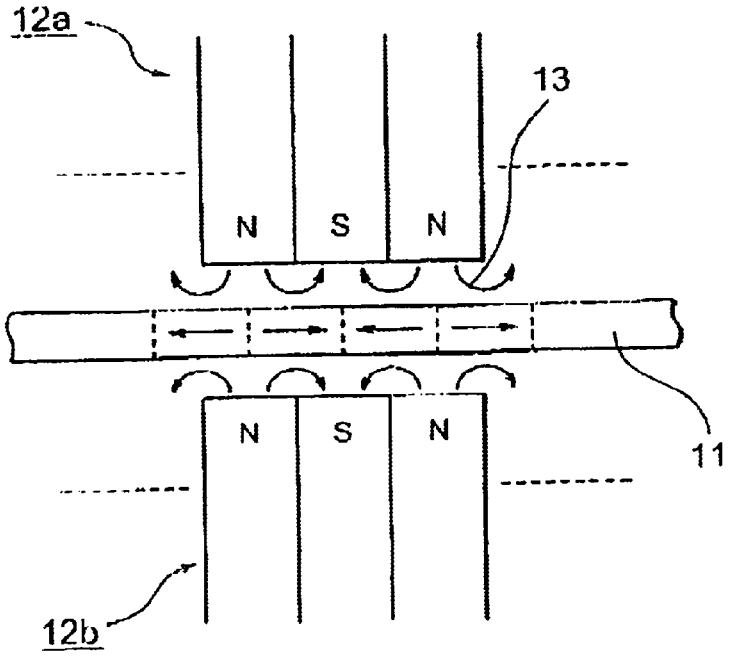
FIG. 7 is a schematic view of a method of multipolar-magnetization in a longitudinal direction to the magnetic layer in a method of producing a magnetic sticking sheet of the present invention.

FIG. 7 shows the principle of the method of multipolar-magnetization longitudinally to the magnetic layer. When magnetizing a magnetized object 11 having at least a magnetic layer on a non-magnetic base to produce the magnetic sticking sheet, as shown in FIG. 7, it is preferable to place a pair of magnets 12*a*, 12*b* alternately magnetized to N-poles and S-poles at the two sides of the magnetized object 11, that is, the side of the magnetized object 11 having the magnetic layer and the other side, so that the same magnetic poles face each other closely. Due to the pair of magnets 12*a*, 12*b*, an extrinsic magnetic field shown by the magnetic lines of force 13 is supplied to the magnetic layer. Due to this, the magnetic layer is multipolar-magnetized with magnetization alternately reversing longitudinally to the magnetic layer.

Figure 8:
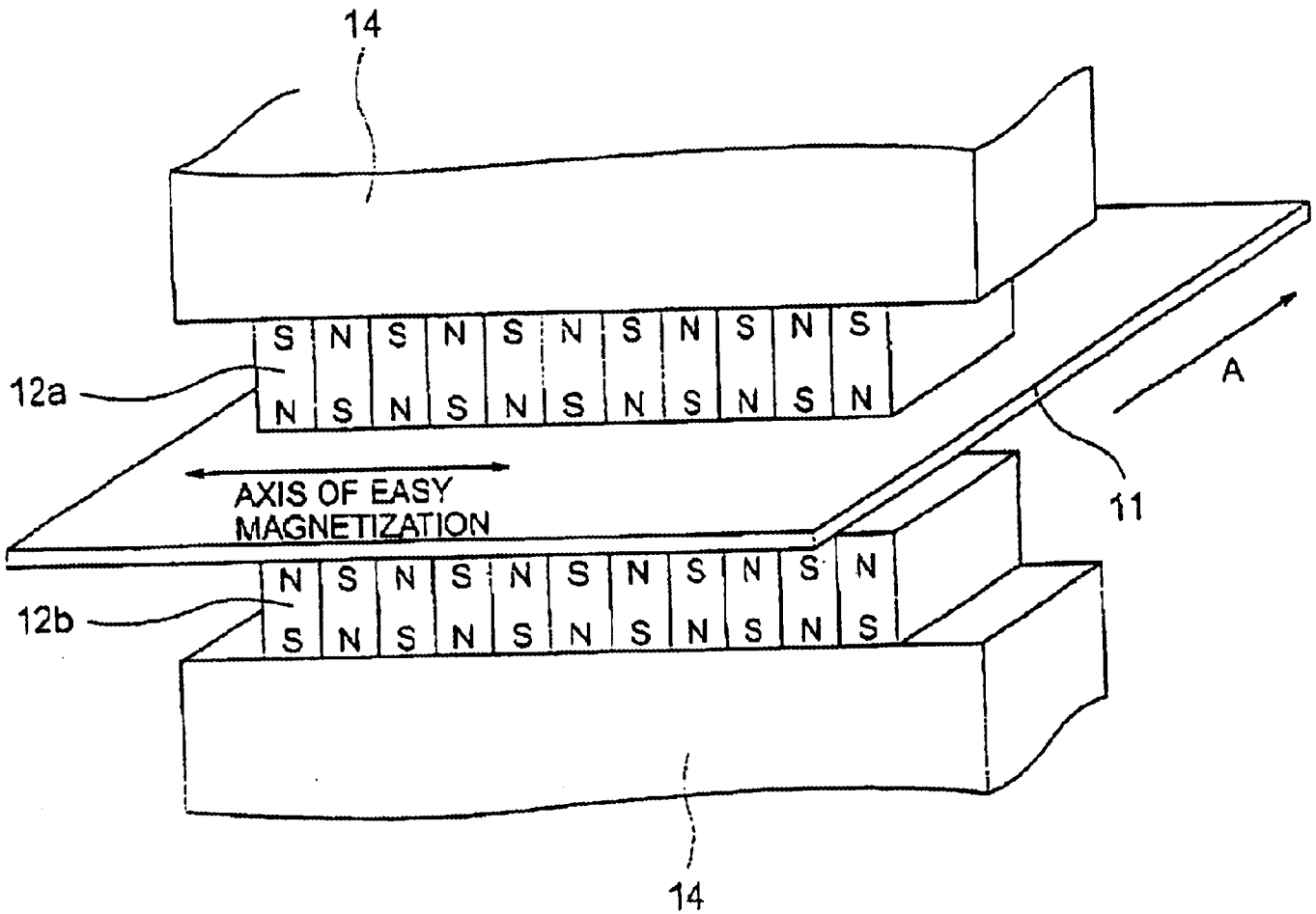
FIG. 8 is a schematic view of a method of multipolar-magnetization in a longitudinal direction to the magnetic layer in a method of producing a magnetic sticking sheet of the present invention.

FIG. 8 is a schematic view of a method of multipolar-magnetization in a longitudinal direction to the magnetic layer. As shown in FIG. 8, a pair of prism-shaped permanent magnets 12*a*, 12*b* alternately magnetized to N-poles and S-poles in the longitudinal direction are placed straddling the magnetized object 11. That is, one magnet is placed at one side of the magnetized object 11 having the magnetic layer, while the other magnet is placed at the other side of the magnetized object 11. The same magnetic poles of the permanent magnets 12*a*, 12*b* closely face each other across the magnetized object 11.

As the permanent magnets 12*a*, 12*b*, rare earth permanent magnets can be used. These permanent magnets 12*a*, 12*b* are placed on yokes 14. By moving the magnetized object 11 in a direction perpendicular to the axis of easy magnetization (direction shown with an arrow A of FIG. 8) to magnetize it, the magnetic sticking sheet of the present embodiment is produced.

In this case, it is not necessary to provide equipment generating a strong magnetic field etc. consuming a large amount of power as opposed to the case of producing a conventional magnetic sticking sheet having an axis of easy magnetization in a direction perpendicular to the surface of the magnetic layer. Since the equipment generating the magnetic field does not become large in scale, the energy consumption is reduced and the cost of production can be suppressed.

Also, as the source of the magnetic field required for magnetization, a rare earth permanent magnet can be used as shown in, for example, FIG. 8. When using a magnetic field generated by rare earth magnets, it becomes unnecessary to supply extrinsic energy for magnetization and magnetization can be performed semipermanently. Therefore, this can effectively reduce the cost in producing a magnetic sticking sheet of the present invention.

The timing of magnetization is not particularly limited. For example, it can be after forming the magnetic layer and just after orienting the axis of easy magnetization. Also, it can be after orienting the axis of easy magnetization and rolling and cutting the magnetized object to a predetermined size. Further, the magnetization can be performed at almost the same time as printing on the printable layer after forming the printable layer on the magnetic layer, orienting the axis of easy magnetization, and cutting the magnetized object to a predetermined size. In addition, magnetization can be performed before or after printing on the printable layer after cutting the magnetized object to a predetermined size.

As described above, the surface of the non-magnetic base on the opposite side of the magnetic layer can be provided with a layer printable by any printing method. As the printable layer, a thermal layer, thermal transfer ink printable layer, ink jet printable layer, bubble jet printable layer, dot impact printable layer, laser printable layer, offset printable layer, or other functional layer corresponding to various printing methods can be formed. The type of the printable layer can be appropriately selected depending on the purpose of display and method of printing.

The thickness of the non-magnetic base is preferably in a range from 0.05 to 0.15 mm. When the rolled magnetic sticking sheet of the present embodiment has the printable layer, it is preferable that the thickness of the non-magnetic base including the printable layer be 0.05 to 0.15 mm. If the thickness of the non-magnetic base is less than 0.05 mm and the sheet is used for display with the printable layer printed, the color of the magnetic layer will appear through the non-magnetic base so the appearance may be deteriorated.

The thickness of the magnetic layer is preferably in a range from 0.03 to 0.10 mm. Since the magnetic energy of a magnet is proportional to the volume of the magnet, when the thickness of the magnetic layer is less than 0.03 mm, a sufficient magnetic sticking force cannot be obtained. For example, when the magnetic sticking sheet is required to stick on a surface such as a wall vertical to the ground, if the magnetic layer is too thin, the total weight of the magnetic sticking sheet including the magnetic layer and non-magnetic base may not be supported by the magnetic sticking force of the magnetic layer and the magnetic sticking sheet may fall.

Also, if the thickness of the magnetic layer exceeds 0.10 mm, even if a sufficient magnetic sticking force is obtained, the coating film is liable to break due to mechanical fatigue after a long period of use with repeated deformation of sheet shape during attachment or detachment.

The total thickness of the magnetic sticking sheet of the present embodiment is preferably 0.08 to 0.25 mm. If the total thickness of the magnetic sticking sheet including the magnetic layer exceeds 0.25 mm, the sheet is outside of the range of thickness printable by a general personal printer.

In the roll-type magnetic sticking sheet of the present embodiment, the distance between magnetic poles does not depend on the thickness of the magnetic layer, so the distance between magnetic poles is secured sufficiently even when making the magnetic layer thinner. Therefore, the demagnetizing field does not increase and demagnetization is difficult. Due to this, as described above, it is possible to achieve a thinness equivalent to normal paper by making the thickness of the magnetic layer 0.03 to 0.10 mm and total thickness 0.08 to 0.25 mm.

The coercive force of the magnetic particles mixed in the magnetic layer is preferably in a range from about 700 to 4000 Oe. As the magnetic particles, for example, Ba ferrite particles, Sr ferrite particles, or other ferromagnetic iron oxide particles can be used.

Magnetization of a magnetic material usually requires a magnetic field several times stronger than the field of the material to be magnetized. Since ferromagnetic iron oxide usually has a coercive force of 4000 Oe or less, in the case of use for the present invention, it can be sufficiently magnetized by the magnetic field of rare earth permanent magnets such as ones listed below.

As a cylindrical, prismatic, or other type of permanent magnet preferably used for the present invention, for example, an Sm—Co magnet, Sm—Fe—N magnet, Nd—Fe—B magnet, or other rare earth permanent magnet can be mentioned. For magnetization of a magnetic material, the material usually has to be exposed to a magnetic field of more than the coercive force of the material. For magnetization of a material containing ferromagnetic iron oxide, a magnetic field of twice or more the coercive force of the ferromagnetic iron oxide is sufficient.

Usually, the coercive force of ferromagnetic iron oxide is 4000 Oe or less, so the magnetized object can be magnetized if using a permanent magnet able to generate a magnetic field of 8000 Oe or more, that is, twice the coercive force of the magnetized object. Also, when the coercive force of ferromagnetic iron oxide is 3000 Oe or less, a permanent magnet able to generate a magnetic field of 6000 Oe or more is sufficient for magnetization.

A ferrite permanent magnet has a saturation magnetic flux density of 4000G or less. Even if using a magnet having a strong magnetic field, the maximum value of the generated magnetic field does not exceed the saturation magnetic flux density. Therefore, in the case of magnetization requiring a magnetic field of 6000 to 8000 Oe or more, ferrite permanent magnets are not suitable.

On the other hand, a rare earth permanent magnet usually has a saturation magnetic flux density of 8000 to 15000G or more, so is especially preferable for magnetization. Also, when using a magnetic field of a rare earth or other type of permanent magnet, it is unnecessary to input extrinsic energy for magnetization and the magnetization can be performed semipermanently. Therefore, the cost of production can be effectively reduced when forming the roll-type magnetic sticking sheet of the present invention.

As the binder mixed with the magnetic particles, for example, a thermoplastic resin, thermosetting resin, reaction-type resin, or mixture of these resins can be mentioned. As examples of the thermoplastic resin, a polymer or copolymer containing vinyl chloride, vinyl acetate, vinyl alcohol, maleic acid, acrylic acid, acrylic ester, vinylidene chloride, acrylonitrile, methacrylic acid, methacrylic ester, styrene, butadiene, ethylene, vinyl butyral, vinyl acetal, and vinyl ether can be mentioned.

As a copolymer, for example, a vinyl chloride-vinyl acetate copolymer, vinyl chloride-vinylidene chloride copolymer, vinyl chloride-acrylonitrile copolymer, acrylic ester-acrylonitrile copolymer, acrylic ester-vinylidene chloride copolymer, acrylic ester-styrene copolymer, methacrylic ester-acrylonitrile copolymer, methacrylic ester-vinylidene chloride copolymer, methacrylic ester-styrene copolymer, vinylidene chloride-acrylonitrile copolymer, butadiene-acrylonitrile copolymer, styrene-butadiene copolymer, and chlorovinyl ether-acrylic ester copolymer can be mentioned.

In addition, a polyamide resin, cellulose resin (cellulose acetate butyrate, cellulose diacetate, cellulose propionate, nitrocellulose, etc.), polyvinyl fluoride, polyester resin, polyurethane resin, various types of rubber type resins, etc., can also be used.

As a thermoplastic resin or reaction-type resin, for example, a phenol-formaldehyde resin, epoxy resin, polyurethane curing type resin, urea resin, melamine resin, alkyd resin, acrylic reactive resin, formaldehyde resin, silicone resin, epoxy-polyamide resin, a mixture of a polyester resin and polyisocyanate prepolymer, a mixture of a polyester polyol and polyisocyanate, and a mixture of polyurethane and polyisocyanate can be mentioned.

As the method of forming the magnetic layer on the non-magnetic base, a method of coating on the non-magnetic base a magnetic coating material obtained by dispersing ferromagnetic particles in binder and solvent may be mentioned. For coating the coating material, for example, a gravure coater, die coater, knife coater, or other coater is used.

Figure 9:
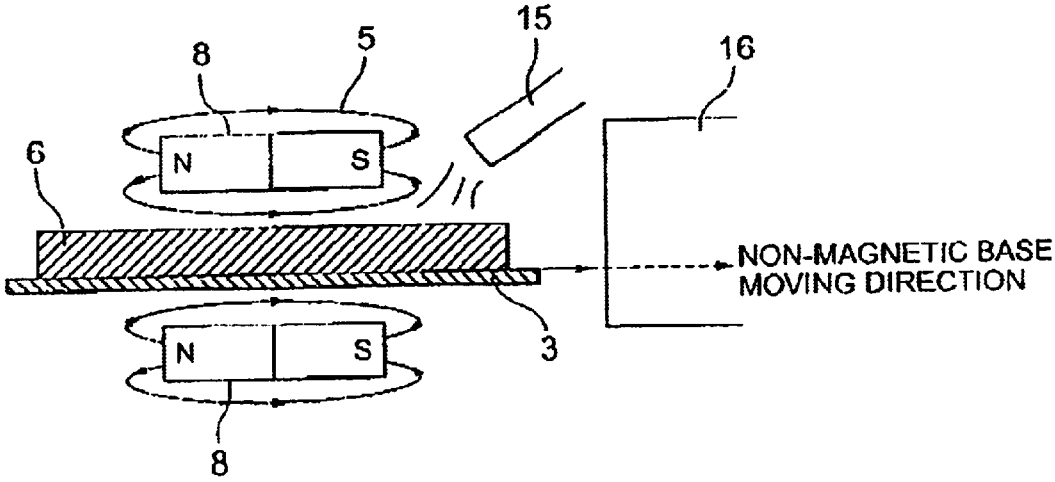
FIG. 9 is a schematic view of orientation of an axis of easy magnetization of magnetic particles longitudinally to the magnetic layer by drying in a magnetic field in a method of producing a magnetic sticking sheet of the present invention.

After coating the coating material, the solvent in the coating material is evaporated by a hot air dryer to harden the coated film. In the drying process, as shown in FIG. 9, at the same time with blowing hot air from a nozzle 15 of the hot air dryer on the magnetic coating film 6, a magnetic field is applied to the magnetic coating film 6 to dry it in the magnetic field. Due to this, it becomes easy to orient the axis of easy magnetization to give an 80% or more squareness ratio. The magnetic coating film 6 dried in the magnetic field is further dried in a dryer 16.

Although FIG. 9 shows a case of orientation of magnetic particles using permanent magnets 8, in the same manner as FIG. 4, it is also possible to dry the film in a magnetic field with hot air blown from the nozzle 15 as shown in FIG. 9 when using electromagnets using solenoid coils.

Also, when forming the magnetic layer by coating a magnetic coating material, a thin magnetic layer can be continuously formed without using high temperature and high pressure equipment such as an extruder.

When multipolar-magnetizing a magnetic layer having an axis of easy magnetization longitudinal to the magnetic layer along the axis of easy magnetization such as (N-S) (S-N) (N-S) . . . as shown in FIG. 6, a leakage magnetic flux maximized at a perpendicular direction is generated from S-S or N-N facing magnetic pole surfaces. Due to this, a magnetic sticking force is effectively exhibited between the magnetic layer and a steel or other ferromagnetic wall surface.

It is preferable that the axis of easy magnetization of the magnetic layer be oriented longitudinally to give a 80% or more squareness ratio as calculated from the curve of magnetization in the longitudinal direction. If the squareness ratio is less than 80%, the residual magnetic flux density after magnetization is insufficient and a sufficient magnetic sticking force cannot be obtained.

As the non-magnetic base used for the present invention, in consideration of its use coated with the magnetic coating material, a coated paper coated with a resin so that a solvent is prevented from penetrating from the surface coated with the magnetic coating material to the back surface, synthetic paper, white or colored synthetic film, etc. is desirable. Specifically, white polyester film, polypropylene film, etc. treated for easier adhesion can be mentioned.

Below, an explanation will be made of the roll-type magnetic sticking sheet of the present embodiment based on examples of actual production. Note, however, that the present invention is not limited to the following examples.

EXAMPLE 1

The following ingredients were mixed by a ball mill and dispersed homogeneously to prepare a magnetic coating material.

TABLE 1

| Magnetic Coating Materials | | |
|---|---|---|
| Magnetic particles | Sr ferrite | 100 parts by weight |
| Binder | Polyester polyurethane | 10.8 parts by weight |
| | Cellulose acetate butyrate (CAB) | 4.6 parts by weight |
| Solvent | Methyl ethyl ketone | 66 parts by weight |

As the Sr ferrite, isotropic particles having an average particle size of 1.2 $\mu$m, saturation magnetization $\sigma_s$ of 59 emu/g, and coercive force Hc of 2800 Oe were used.

As the polyester polyurethane resin, Nipporan® (made by Nippon Polyurethane Industry Co., Ltd.) having a number average molecular weight Mn of 30,000 and a glass transition temperature Tg of −10° C. was used. As the cellulose acetate butyrate, a product of Eastman Chemical having a Tg of 101° C. was used.

A curing agent (brand name: Coronate HL (made by Nippon Polyurethane Industry Co., Ltd.)) was added to this coating material in an amount of 0.3 part by weight. After this, the coating material was coated on the opposite surface of a printable layer of white synthetic paper containing an ink jet printable layer as a non-magnetic base (thickness of 0.09 mm, brand name: Toyojet (made by Toyobo Co., Ltd.)) with a knife coater at a coating speed of 10 m/min.

Next, the sheet was passed through a longitudinally oriented magnetic field of 2.7 kG formed by permanent magnets arranged so that the same magnetic poles faced each other and, simultaneously, hot air was blown from a hot air dryer to dry the coated film and orient it longitudinally (drying in magnetic field). The coated film was dried further to obtain a rolled sheet having a thickness of the magnetic layer of 0.06 mm and a total thickness of 0.15 mm.

The coated film was cured by keeping the obtained sheet in a 60° C. atmosphere for 20 hours or more, then, as shown in FIG. 8, the magnetic layer was multipolar-magnetized alternately in the longitudinal direction. Here, a large number of plate type magnets were arranged with alternating magnetic poles such as N-S-N and with the same magnetic poles facing each other across the sheet. The sheet was passed through the space between the magnets for multipolar-magnetization. Due to this, a roll-type magnetic sticking sheet was obtained.

EXAMPLE 2

Except for changing the thickness of the magnetic layer after drying to 0.03 mm, the same procedure as in Example 1 was followed to obtain a roll-type magnetic sticking sheet having a total thickness of 0.12 mm.

EXAMPLE 3

Except for changing the thickness of the magnetic layer after drying to 0.10 mm, the same procedure as in Example 1 was followed to obtain a roll-type magnetic sticking sheet having a total thickness of 0.19 mm.

EXAMPLE 4

Except for changing the thickness of the magnetic layer after drying to 0.15 mm, the same procedure as in Example 1 was followed to obtain a roll-type magnetic sticking sheet having a total thickness of 0.26 mm.

EXAMPLE 5

Except for changing the thickness of the magnetic layer after drying to 0.02 mm, the same procedure as in Example 1 was followed to obtain a roll-type magnetic sticking sheet having a total thickness of 0.11 mm.

EXAMPLE 6

Except for changing the thickness of the magnetic layer after drying to 0.17 mm, the same procedure as in Example 1 was followed to obtain a roll-type magnetic sticking sheet having a total thickness of 0.26 mm.

EXAMPLE 7

Except for changing the thickness of the magnetic layer after drying to 0.20 nm, the same procedure as in Example 1 was followed to obtain a roll-type magnetic sticking sheet having a total thickness of 0.29 mm.

EXAMPLE 8

Except for changing the magnetic field for the longitudinal orientation to 1.0 kG, the same procedure as in Example 1 was followed to obtain a roll-type magnetic sticking sheet.

EXAMPLE 9

Except for changing the magnetic field for the longitudinal orientation to 1.0 kG, the same procedure as in Example 2 was followed to obtain a roll-type magnetic sticking sheet.

EXAMPLE 10

Except for changing the magnetic field for the longitudinal orientation to 1.0 kG, the same procedure as in Example 3 was followed to obtain a roll-type magnetic sticking sheet.

EXAMPLE 11

Except for changing the magnetic field for the longitudinal orientation to 1.0 kG, the same procedure as in Example 4 was followed to obtain a roll-type magnetic sticking sheet.

EXAMPLE 12

Except for not drying the magnetic coated film in the magnetic field and drying the coated film with hot air blown from a hot air dryer after passing the sheet through a longitudinally oriented magnetic field of 2.7 kG, the same procedure as in Example 1 was followed to obtain a roll-type magnetic sticking sheet having a total thickness of 0.15 mm.

The results of evaluation of the squareness ratio, surface magnetic flux density, magnetic sticking force, roll shape, and state of sticking of each example described above are shown in Table. 2.

TABLE 2

| Example | Thickness of magnetic layer (mm) | Magnetic field of orient-ation (kG) | Square-ness ratio (%) | Surface magnetic flux density (G) | Magnetic sticking force (gf/cm$^2$) | Roll shape | State of sticking |
|---|---|---|---|---|---|---|---|
| 1 | 0.06 | 2.7 | 87 | 60 | 0.63 | Good | Good |
| 2 | 0.03 | 2.7 | 90 | 35 | 0.30 | Good | Good |
| 3 | 0.10 | 2.7 | 80 | 95 | 0.90 | Good | Good |
| 4 | 0.15 | 2.7 | 78 | 125 | 1.00 | Fair | Good |
| 5 | 0.02 | 2.7 | 92 | 20 | 0.25 | Good | Poor |
| 6 | 0.17 | 2.7 | 90 | 150 | 1.20 | Fair | Good |
| 7 | 0.20 | 2.7 | 90 | 185 | 1.60 | Poor | Good |
| 8 | 0.06 | 1.0 | 65 | 20 | 0.20 | Good | Poor |
| 9 | 0.03 | 1.0 | 75 | 20 | 0.21 | Good | Poor |
| 10 | 0.10 | 1.0 | 60 | 25 | 0.23 | Good | Poor |
| 11 | 0.15 | 1.0 | 60 | 27 | 0.27 | Good | Poor |
| 12 | 0.06 | 2.7 | 65 | 30 | 0.25 | Good | Poor |

The squareness ratio was measured by using a vibration type magnetic characteristic measurement system (brand name VSM, made by Toei Kogyo).

The surface magnetic flux density was measured by using a Gauss meter (Model 4048, made by Bell) and a transverse type probe (T-4048-001) with a probe plane contacting a measured part of the surface of the magnetic layer. The measured values at any five points were averaged.

Note that in Japanese Unexamined Patent Publication (Kokai) No. 2001-76920 described above, the magnetic sticking force was measured by sliding a magnetic sheet fixed on a steel plate in a parallel direction to the plate. According to experimental data, when sliding the sheet in this manner, the magnetic sticking force becomes almost the same or larger by about 10% compared with the case of the present embodiment where the sheet is peeled off in a perpendicular direction to the stuck plate.

The magnetic sticking force was measured by cutting the roll-type magnetic sticking sheet to a 100 mm×100 mm size, adhering a resin sheet of the same shape as the cut sheet by an adhesive to the back surface of the magnetic sticking surface, attaching this magnetically to a steel plate having a thickness of 0.5 mm fixed horizontally, and measuring the minimum peeling force by using a spring balance when peeling off the sheet from the steel plate in a vertically upward direction. Here, the magnetic sticking force was derived from the equation {minimum peeling force−(sheet weight+adhesive weight+resin sheet weight)}/area of sheet The roll shape was observed by rolling a 30 m length of each sample sheet to a diameter of 3 inch (≈7.6 cm) and leaving it in a rolled state. When the ends of the roll did not become flat and the roll was slack, the roll was evaluated as "poor". When the ends of the roll did not become flat but the roll was not slack, the roll was evaluated as "fair". When the ends of the roll became flat and the roll was not slack, the roll was evaluated as "good".

The state of sticking was checked by cutting each sheet to a A4 size and sticking it on a steel plate having a thickness of 0.5 mm vertical to the ground. When the sheet slipped down, it was evaluated as "poor". When no slipping of the sheet was observed, it was evaluated as "good".

From Table 2, it is found that a sheet stuck on a surface vertical to the ground slips down when the magnetic sticking force is less than 0.3 gf/cm$^2$. On the other hand, when the magnetic sticking force exceeds 0.9 gf/cm$^2$, the ends of the roll do not become flat. Further, when the magnetic sticking force was 1.6 gf/cm$^2$, the roll became slack.

When looking at the surface magnetic flux density, it is found that a good roll shape and state of sticking can be obtained if the surface magnetic flux density is about 40 to 100G. When looking at the squareness ratio, which shows the extent of orientation in the longitudinal direction, it is found that an adequate magnetic sticking force cannot be obtained if it is less than 80%. Also, when looking at the thickness of the magnetic layer, it is found that a good roll shape and magnetic sticking force can be obtained if the thickness is 0.03 to 0.10 mm.

As described above, according to the roll-type magnetic sticking sheet of the embodiment of the present invention, it is possible to print the sheet by for example a large size paper printer etc. and obtain a magnetic sticking force suitable for both storage in a rolled state and sticking on a wall etc. in an unrolled sheet state.

Also, according to the method of producing a magnetic sticking sheet of the embodiment of the present invention, it is possible to produce a thin and roll-type magnetic sticking sheet having a small demagnetizing field and resistant to demagnetization with a low production cost.

The magnetic sticking sheet and method of producing the same of the present invention are not limited to the above embodiment. For example, in the multipolar-magnetization step of the magnetic layer, instead of using the pair of magnets 12*a*, 12*b* as shown in FIG. 7, it is possible to place a magnet only on one side of the magnetized object 11 so that the magnet faces the magnetic layer of the object. Also, the composition of the binder in the magnetic coating material etc. can be changed.

In addition, various modifications may be made within a range within the gist of the present invention.

Summarizing the effects of the present invention, according to the present invention, it is possible to realize a thin magnetic sticking sheet giving a good rolled shape when rolled, printable by a printer, suitable for sticking on a wall, etc.

Further, according to the method of producing a magnetic sticking sheet of the present invention, it is possible to produce a magnetic sticking sheet having an axis of easy magnetization in a longitudinal direction of the magnetic layer, multipolar-magnetized in the longitudinal direction, and having a high squareness ratio by a low cost.

Note that the present invention is not limited to the above embodiments and includes modifications within the scope of the claims.

What is claimed is:

1. A method of producing a magnetic sticking sheet comprising the steps of:

coating on a non-magnetic base a magnetic coating material comprised of ferromagnetic particles dispersed in binder to form a coated film;

orienting an axis of easy magnetization of the ferromagnetic particles in a parallel direction to the coated film by applying a magnetic field;

drying the coated film while orienting the axis of easy magnetization by drying in the magnetic field to obtain a squareness ratio of 80 to 90% in the parallel direction to the coated film;

further drying the coated film to form a magnetic layer; and multipolar-magnetizing the magnetic layer as the magnetization inverts alternately in the parallel direction to the magnetic layer, the step of multipolar-magnetization including the step of placing a combined permanent magnet comprised of a plurality of magnets stacked facing each other with different magnetic poles so as to face at least a side of the magnetic sticking sheet where the magnetic layer is formed.

2. A method of producing a magnetic sticking sheet as set forth in claim 1, wherein the multipolar-magnetization step includes the step of placing a pair of combined permanent magnets, each comprising a plurality of magnets stacked to face each other with different magnetic poles, so as to face each other across the magnetic sticking sheet with the same magnetic poles.

3. A method of producing a magnetic sticking sheet as set forth in claim 1, further comprising a step of rolling the magnetic sticking sheet after the multipolar-magnetization step.

4. A method of producing a magnetic sticking sheet as set forth in claim 1, further comprising a step of printing the surface of the magnetic sticking sheet at the non-magnetic base side after the multipolar-magnetization step.

* * * * *